US011585538B2

(12) United States Patent
Yun et al.

(10) Patent No.: US 11,585,538 B2
(45) Date of Patent: Feb. 21, 2023

(54) COOKING APPLIANCE

(71) Applicant: LG Electronics Inc., Seoul (KR)

(72) Inventors: Seongjun Yun, Seoul (KR); Namil Lee, Seoul (KR); Seungjun Lee, Seoul (KR); Seungtae Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 98 days.

(21) Appl. No.: 17/159,893

(22) Filed: Jan. 27, 2021

(65) Prior Publication Data

US 2021/0148579 A1 May 20, 2021

Related U.S. Application Data

(62) Division of application No. 16/385,059, filed on Apr. 16, 2019, now Pat. No. 10,969,114.

(30) Foreign Application Priority Data

Apr. 16, 2018 (KR) ..... 10-2018-0044026

(51) Int. Cl.
*F24C 15/02* (2006.01)
*F24C 7/08* (2006.01)
*F24C 15/00* (2006.01)

(52) U.S. Cl.
CPC ..... *F24C 15/028* (2013.01); *F24C 7/088* (2013.01); *F24C 15/006* (2013.01)

(58) Field of Classification Search
CPC ..... F24C 15/028; F24C 7/088; F24C 15/006; F24C 15/02
See application file for complete search history.

(56) References Cited

U.S. PATENT DOCUMENTS 7,348,527 B2 * 3/2008 Braunisch ..... H05B 6/6423 219/757
8,035,065 B2 10/2011 Kim et al.
(Continued)

FOREIGN PATENT DOCUMENTS

CN 1628584 6/2005
CN I985605 6/2007
(Continued)

OTHER PUBLICATIONS

EP Extended European Search Report in European Appln. No. 19169225.0, dated Jun. 4, 2021, 7 pages.
(Continued)

*Primary Examiner* — David J Laux
(74) *Attorney, Agent, or Firm* — Fish & Richardson P.C.

(57) ABSTRACT

A cooking appliance includes a body that defines a cooking chamber therein, a door rotatably connected to the body and configured to open and close at least a portion of the cooking chamber, a hinge mechanism that rotatably connects the door to the body, and a control device disposed in the door. The control device includes a control housing that is configured to accommodate one or more components of the control device and that includes a first sidewall that defines an air inlet, and a second sidewall that defines an air outlet, an inlet-side cooling fan disposed at a first position of the control housing closer to the air inlet than the air outlet, and an outlet-side cooling fan disposed at a second position of the control housing closer to the air outlet than the air inlet.

12 Claims, 11 Drawing Sheets

(56) References Cited

U.S. PATENT DOCUMENTS

| | | | | |
|---|---|---|---|---|
| 8,039,775 | B2 * | 10/2011 | Venezia | F24C 15/006 126/193 |
| 8,716,631 | B2 | 5/2014 | Venezia et al. | |
| 2005/0133019 | A1 | 6/2005 | Kim et al. | |
| 2007/0158340 | A1 | 7/2007 | Kim et al. | |
| 2008/0105248 | A1 | 5/2008 | Lee | |
| 2009/0255918 | A1 | 10/2009 | Venezia et al. | |
| 2011/0214661 | A1 | 9/2011 | Hyun et al. | |
| 2014/0048055 | A1 | 2/2014 | Ruther | |
| 2016/0033143 | A1 | 2/2016 | Lee et al. | |
| 2017/0082297 | A1 | 3/2017 | Ivanovic et al. | |
| 2017/0261213 | A1 | 9/2017 | Park et al. | |

FOREIGN PATENT DOCUMENTS

| | | |
|---|---|---|
| CN | 102188169 | 9/2011 |
| CN | 106132257 | 11/2016 |
| EP | 2520169 | 11/2012 |
| EP | 2816290 | 12/2014 |
| EP | 2980490 | 2/2016 |
| KR | 1020040019624 | 3/2004 |
| KR | 1020070108298 | 11/2007 |
| KR | 100803773 | 2/2008 |
| KR | 100819593 | 4/2008 |
| KR | 101580683 | 12/2015 |
| WO | WO 2015/185211 | 12/2015 |

OTHER PUBLICATIONS

KR Office Action in Korean Appln. No. 10-2020-0005004, dated May 3, 2021, 10 pages (with English translation).

Office Action in Chinese Appln. No. 201910303097.6, dated Nov. 3, 2021, 17 pages (with English translation).

Extended European Search Report in European Application No. 19169225.0, dated Aug. 19, 2019, 9 pages.

Communication under Rule 71(3) EPC in European Appln. No. 19169225.0, dated Dec. 15, 2022, 9 pages.

* cited by examiner

COOKING APPLIANCE

CROSS-REFERENCE TO RELATED APPLICATION

This application is a divisional of U.S. application Ser. No. 16/385,059, filed on Apr. 16, 2019, which claims the benefit of priority to Korean Patent Application No. 10-2018-0044026, filed on Apr. 16, 2018, in the Korean Intellectual Property Office, the disclosures of which are incorporated herein in their entirety by reference.

TECHNICAL FIELD

The present disclosure relates to a cooking appliance.

BACKGROUND

A cooking appliance is an appliance that can cook food using heat from a heat source.

In some case, the cooking appliance may include a body having a cooking chamber, at least one heat source disposed at the body, and a door connected to the body and configured to open and close the cooking chamber.

The cooking appliance may further include a control device that inputs a command for controlling the cooking appliance and that displays information to a user. The control device may include an operation unit that receives an operation of a user and a display unit which displays information.

In some examples, the control device may be disposed in the body or the door.

In some examples, a cooking apparatus may include a control PCB disposed in a door.

The cooking apparatus may include a cabinet having a cabinet opening defined in a front surface thereof, a door that has a door air gap, that is configured to open and close the cabinet opening, and a control panel installed in the door.

The door may include a control panel portion on which a control panel is installed for integration with the control panel, and the control panel portion may be located at an upper side of the door air gap. The control panel portion may be blocked from the door air gap by a control panel bracket located inside the door.

In the example cooking apparatus described above, air flowing through the inside of the cabinet may discharge from the cabinet through a cabinet exhaust port, and then enter the door through a door opening. Air introduced into the door may flow downward along the door air gap to cool the door.

In some cases, cooling of the control panel may be achieved by preventing or reducing heat transfer from the hot cooking chamber toward the control panel based on a cool air flow in the door air gap.

In some cases, although heat may be also generated in components inside the control panel, the cool air flow in the door air gap may block the heat of the cooking chamber transmitted to the control panel. Therefore, the components inside the control panel may not be cooled by the cool air flow.

The components inside the control panel may be damaged or cause malfunction of the components due to heat.

SUMMARY

The present disclosure describes a cooking appliance having a cooling flow path that prevent air from being transferred to a control device disposed in a door.

The present disclosure further describes a cooking apparatus including a control device that is disposed in a door and that includes at least one component that is configured to be cooled by air flowing through a cooling flow path that is separate from a cooling flow path of the door.

The present disclosure further describes a cooking appliance in which a length of a cooling flow path for cooling components of a control device disposed in a door is increased to improve cooling performance.

The present disclosure further describes a cooking apparatus configured to reduce noise due to rotation of a cooling fan.

The present disclosure further describes a cooking appliance configured to guide air for cooling a door to flow from a lower side of a control device to a body.

According to one aspect of the subject matter described in this application, a cooking appliance includes a body that defines a cooking chamber therein, a door rotatably connected to the body and configured to open and close at least a portion of the cooking chamber, a hinge mechanism that rotatably connects the door to the body, and a control device disposed in the door. The control device includes a control housing that is configured to accommodate one or more components of the control device and that includes a first sidewall that defines an air inlet, and a second sidewall that defines an air outlet, an inlet-side cooling fan disposed at a first position of the control housing closer to the air inlet than the air outlet, and an outlet-side cooling fan disposed at a second position of the control housing closer to the air outlet than the air inlet.

Implementations according to this aspect may include one or more of the following features. For example, the air inlet may include a first air inlet and a second air inlet, and the inlet-side cooling fan may include a first cooling fan disposed at the first air inlet and a second cooling fan disposed at the second air inlet. In some examples, the one or more components of the control device may include a display device that is configured to display information and that is disposed between the inlet-side cooling fan and the outlet-side cooling fan. In some examples, the one or more components of the control device may further include a sensor that is disposed between the display device and the inlet-side cooling fan.

In some implementations, the door may include a first side decoration member that is disposed at an outside of the first sidewall of the control housing and that defines a first slit configured to allow air to pass therethrough, and a second side decoration member that is disposed at an outside of the second sidewall of the control housing and that defines a second slit configured to allow air to pass therethrough. In some examples, the first slit may extend in a first direction, the air inlet may extend in a second direction intersecting the first direction. The second slit may extend in a third direction, and the air outlet may extend in a fourth direction intersecting the third direction.

In some examples, the first sidewall of the control housing may include a first recessed wall that is recessed in a direction away from the first side decoration member, and the first recessed wall may include a fan support rib configured to support the inlet-side cooling fan. In some examples, the second sidewall may include a second recessed wall that is recessed in a direction away from the second side decoration member, and the second recessed wall may include a fan support rib configured to the outlet-side cooling fan.

In some implementations, the door defines: a cooling flow path configured to guide air to thereby cool the door, and a door air outlet configured to discharge air passing through the cooling flow path, where the control device may further include a barrier configured to direct air flowing through the cooling flow path toward the door air outlet. In some examples, the control housing may include a barrier connection portion that connects to the barrier, and that defines a fitting groove configured to receive a portion of the barrier. In some examples, the control housing may further include a barrier supporter configured to support the barrier, and the barrier may be connected to the barrier supporter by a screw.

In some examples, the door may further include a front panel having a rear surface that seats the control device, and the barrier may include a first portion that extends in a direction perpendicular to the front panel of the door, a second portion that extends upwardly from the first portion based on the door being closed and that is inclined with respect to the first portion, a third portion that is bent from the second portion and that extends from the second portion in a direction away from the front panel and perpendicular to the front panel of the door, and a fourth portion that is bent from the third portion and that extends upwardly from the third portion based on the door being closed.

In some examples, the barrier supporter may include a first contact configured to contact the second portion of the barrier, a second contact that is configured to contact the third portion of the barrier and that is configured to engage with the third portion of the barrier by the screw, and a third contact configured to contact the fourth portion of the barrier.

In some implementations, the cooking appliance may further include a control cover configured to cover the control housing, and a sealing member disposed between the control cover and the fourth portion of the barrier. In some examples, the control device may further include a connection bracket connected to the control cover, and the door may further include side decoration members disposed at both lateral sides of the control device. The connection bracket may be configured to engage with the control housing and the side decoration members by a screw in a state in which the control housing accommodates the connection bracket.

According to another aspect, a cooking appliance includes a body that defines a cooking chamber therein, a door rotatably connected to the body and configured to open and close at least a portion of the cooking chamber, a hinge mechanism that rotatably connects the door to the body, and a control device disposed in the door. The door defines: a door cooling flow path configured to, based on the door being closed, guide air in a vertical direction to thereby cool the door; and a component cooling flow path configured to allow air outside of the door to flow through the control device in a direction intersecting the door cooling flow path.

Implementations according to this aspect may include one or more of the following features. For example, the control device may include: a control housing that is configured to accommodate one or more components of the control device and that includes a first sidewall that defines an air inlet, and a second sidewall that defines an air outlet; and at least one cooling fan disposed between the air inlet of the control housing and the air outlet of the control housing. In some examples, the first sidewall faces the second sidewall.

In some implementations, the at least one cooling fan may include: an inlet-side cooling fan disposed at a first portion closer to the air inlet than the air outlet; and an outlet-side cooling fan disposed at a second position closer to the air outlet than the air inlet. In some examples, the door may define at least one hole disposed at a lower side of the door and configured to introduce air into the door cooling flow path.

DETAILED DESCRIPTIONS

Figure 1:
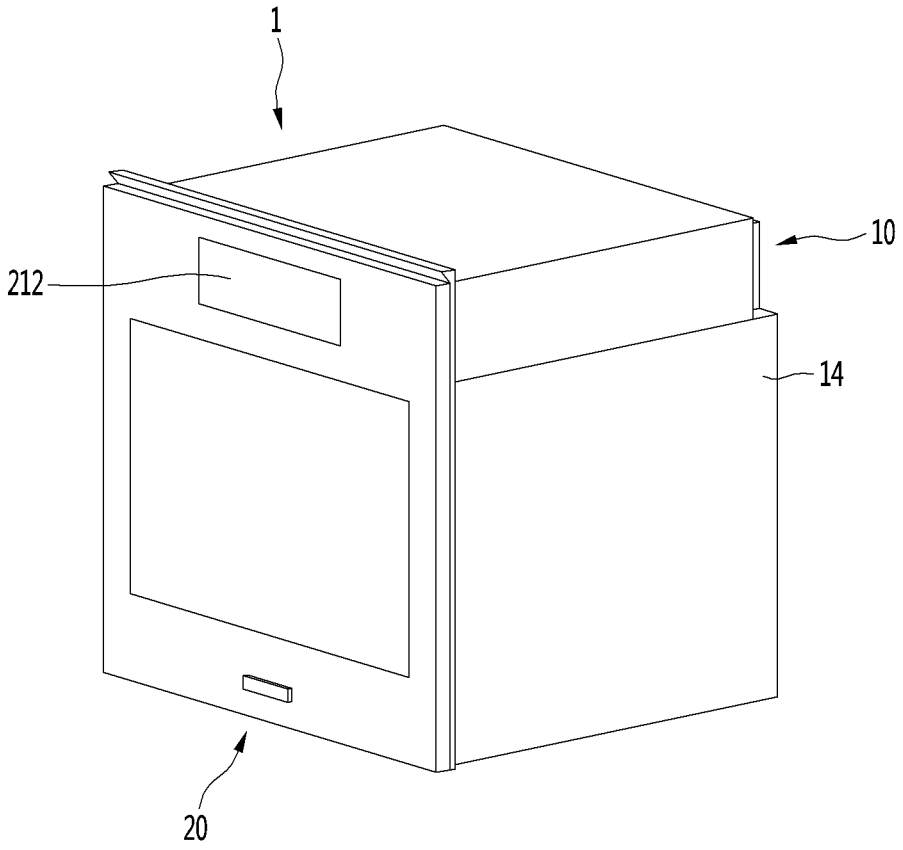
FIG. 1 is a perspective view showing an example cooking appliance.

Hereinafter, one or more implementations of the present disclosure will be described in detail with reference to the accompanying drawings. It should be noted that when components in the drawings are designated by reference numerals, the same components have the same reference numerals as far as possible even though the components are illustrated in different drawings.

Figure 2:
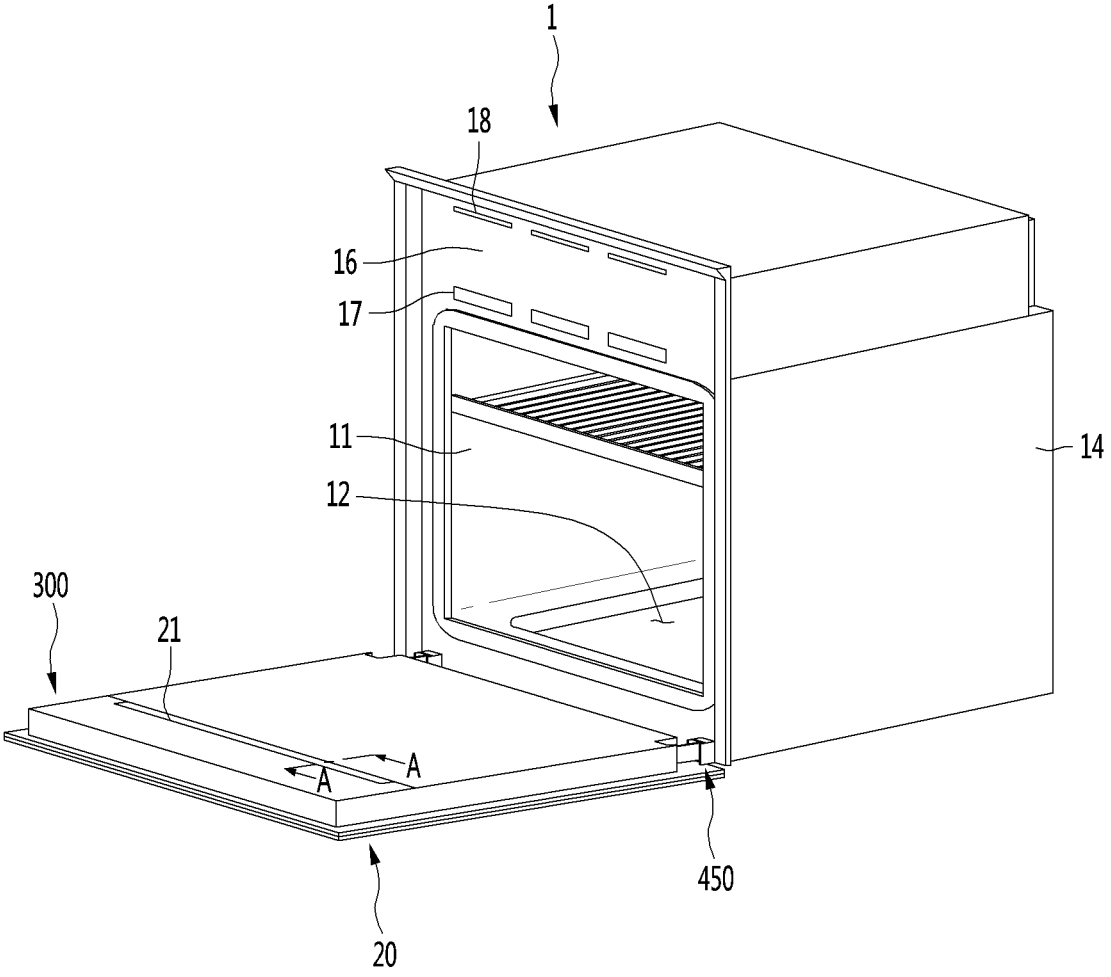
FIG. 2 is a perspective view showing an example door that is opened in the cooking appliance of FIG. 1.
Figure 3:
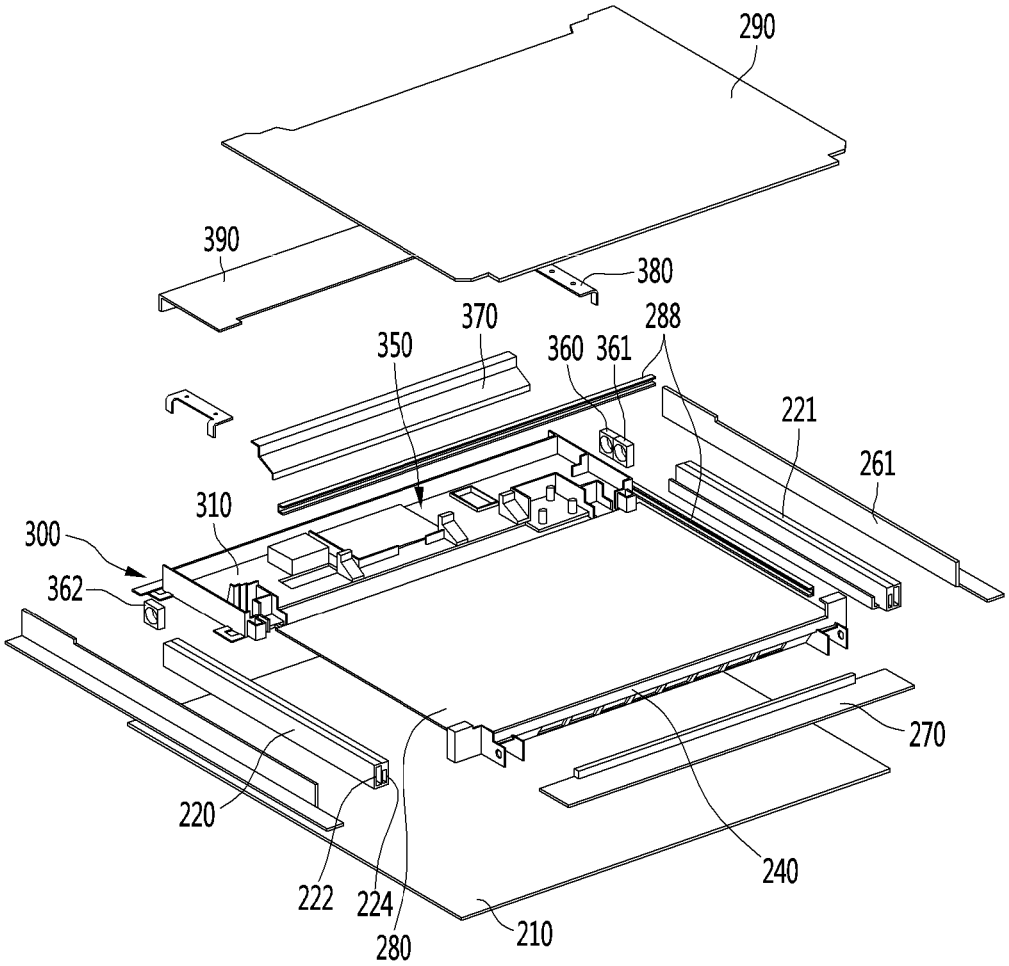
FIG. 3 is an exploded perspective view showing an example door.

FIG. 1 is a perspective view showing an example cooking appliance, FIG. 2 is a perspective view showing an example door that is opened in the cooking appliance of FIG. 1, and FIG. 3 is an exploded perspective view showing an example door.

Figure 4:
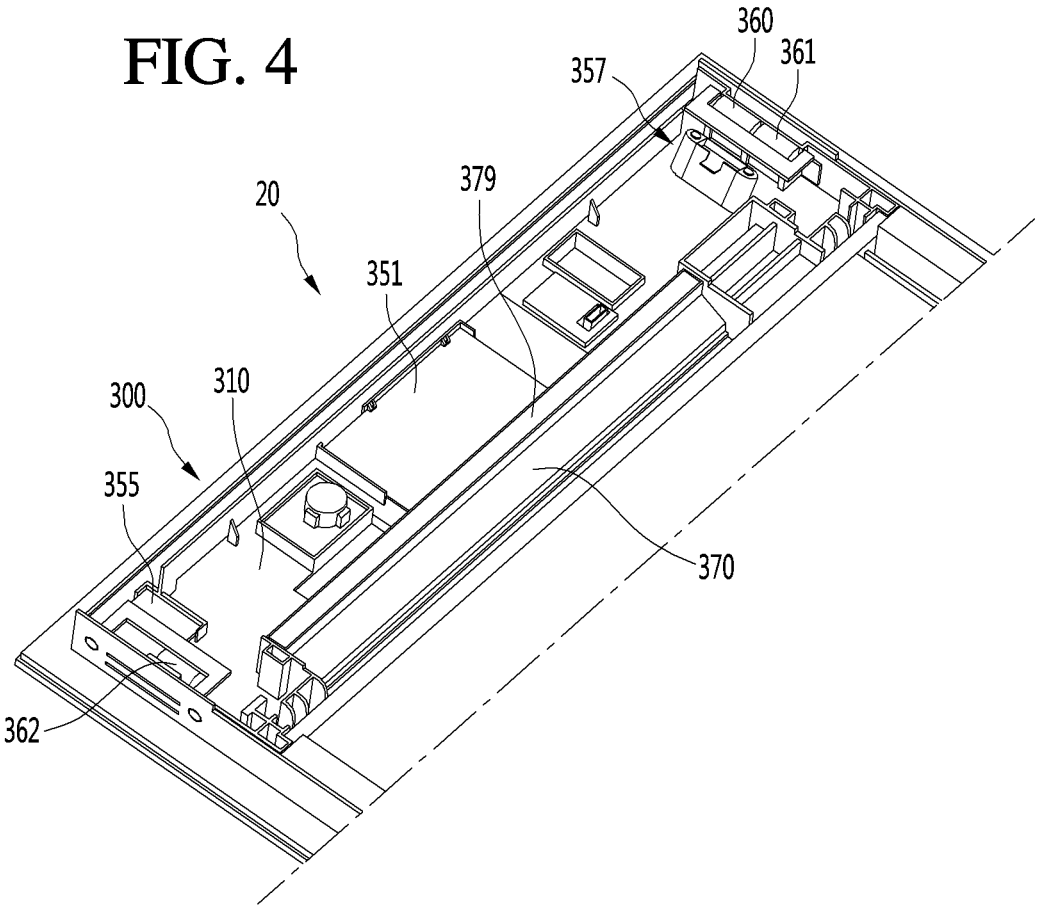
FIG. 4 is a perspective view showing an example control device with a control cover being detached.
Figure 5:
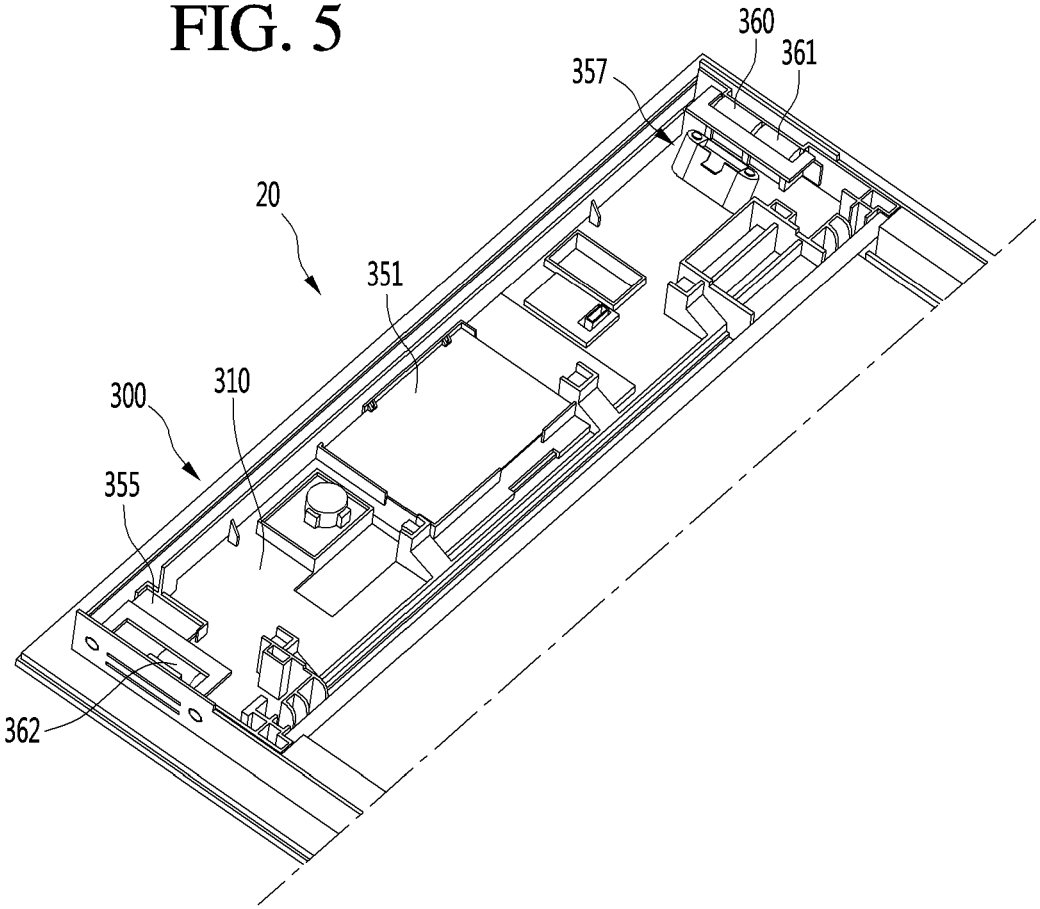
FIG. 5 is a view showing the control device with an example barrier in FIG. 4 being detached.
Figure 6:
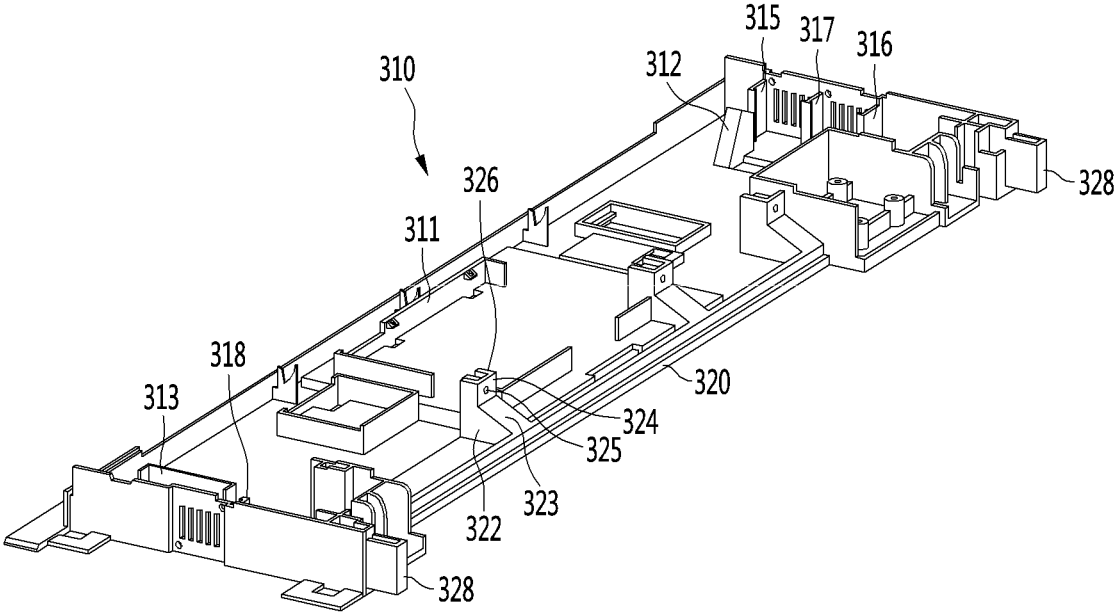
FIG. 6 is a perspective view showing an example control housing.
Figure 7:
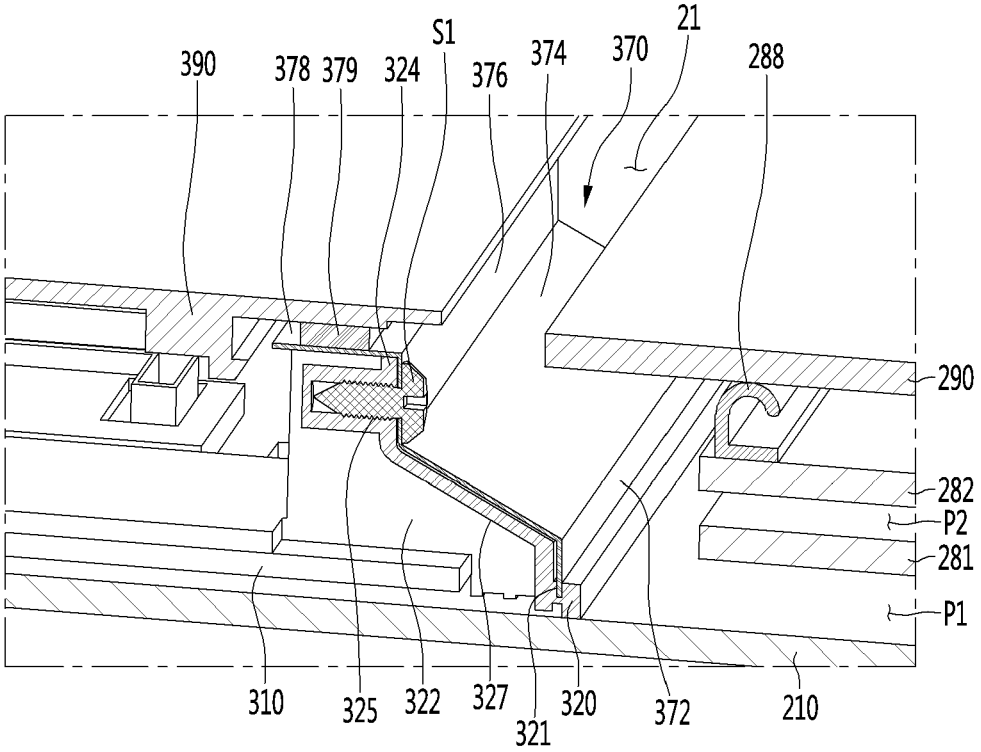
FIG. 7 is a cross-sectional view taken along line A-A of FIG. 2.

FIG. 4 is a perspective view showing an example control device in a state in which an example control cover is detached from the control device. FIG. 5 is a view showing the control device in a state in which an example barrier is detached from the control device in FIG. 4. FIG. 6 is a perspective view showing a control housing, and FIG. 7 is a cross-sectional view taken along line A-A of FIG. 2.

Referring to FIGS. 1 to 7, a cooking appliance 1 may include a body 10 that accommodates various parts therein.

In some implementations, the body 10 may include an inner frame 11 and an outer frame 14 that surrounds the inner frame 11 and that disposed at an outer side of the inner frame 11.

A body panel 16 may be disposed at a front end of the inner frame 11. The body panel 16 may be connected to or may be formed integrally with the front end of the inner frame 11.

The door 20 may be rotatably connected to the body 10 by a hinge mechanism 450. As an example, the hinge mechanism 450 may be connected to the lower end of the door 20.

The outside air of the door 20 may flow into the door 20 in order to minimize or reduce an increase of a temperature of the door 20 due to heat supplied from the cooking chamber 12

In some implementations, the door 20 may define a door air outlet 21 configured to discharge air introduced into the door 20, and the body 10 may define a body air inlet 17 configured to receive air discharged through the door air outlet 21. For instance, the body air inlet 17 may be defined in the body panel 16.

The air introduced into the body 10 through the body air inlet 17 may flow through the body 10. and be then discharged to the outside of the body 10 through a body air outlet 18. The body air outlet 18 may also be defined in the body panel 16.

The door 20 may further include a control device 300.

The control device 300 may be, but limited to, disposed on the upper portion of the door 20 and may be disposed to face a portion positioned on the upper side of the cooking chamber 12 of the body panel 16 in a state where the door 20 is closed.

The control device 300 may include at least one of a display unit and an operation unit. For example, the control device 300 may display operation information of the cooking appliance 1 and/or receive an operation command of the user through the control device 300.

The door 20 may include a front panel 210. The control device 300 may be installed on the rear surface of the front panel 210.

The front panel 210 may form a front appearance of the door 20. Although not limited thereto, the front panel 210 may be made of a glass material, and may form an entire front appearance of the door 20.

The door 20 may further include at least one intermediate panel 280 disposed behind the front panel 210 and spaced apart from the front panel 210 and a rear panel 290 disposed behind the intermediate panel 280.

The at least one intermediate panel 280 may serve as an insulating panel for preventing the heat of the cooking chamber 12 from being transmitted to the outside. The rear panel 290 may cover the cooking chamber 12 when the door 20 is closed.

The intermediate panel 280 and the rear panel 290 may also be made of a glass material. Therefore, the user may check the cooking state of food accommodated in the cooking chamber 12 in a state where the door 20 is closed.

The lower frame 240 may support the intermediate panel 280 and the rear panel 290. In this case, the lower frame 240 may support the intermediate panel 280 such that the intermediate panel 280 is spaced apart from the front panel 210. In addition, the lower frame 240 may support the rear panel 290 such that the rear panel 290 is spaced apart from the intermediate panel 280.

The lower frame 240 may include at least one hole 240*a* through which air passes.

When the door 20 includes a plurality of intermediate panels, the lower frame 240 may support the plurality of intermediate panels in a state where the plurality of intermediate panels are spaced apart from one another.

FIG. 7 illustrates an example in which a first intermediate panel 281 and a second intermediate panel 282 are disposed between the front panel 210 and the rear panel 290.

In some examples, a first cooling flow path P1, which is a door cooling flow path, may be defined between the front panel 210 and the first intermediate panel 281. A second cooling flow path P2, which is a door cooling flow path, may be defined between the first intermediate panel 281 and the second intermediate panel 282.

Air outside the door 20 may be introduced into and flow through the cooling flow paths P1 and P2.

A buffer member 288 may be disposed between the second intermediate panel 282 and the rear panel 290 to absorb a shock while maintaining a predetermined gap therebetween.

The door 20 may include a pair of side frames 220 and 221 installed on a rear surface of the front panel 210 and a lower frame 240 which connects the lower portions of the pair of side frames 220 and 221.

The door 20 may further include a pair of side decoration members 260 and 261 disposed outside the pair of side frames 220 and 221 and a lower decoration members 270 disposed under the lower frame 240.

The control device 300 may include a control housing 310 in which components are accommodated. The components may include a display device 350, a sensor PCB 355, a sensor 357, and the like.

In some implementations, the components that make up the control device 300 may include components that generate heat by themselves, in which it may be necessary to cool those components.

Since the air, introduced from the lower side of the door 20 and passing through the door cooling flow paths P1 and P2 comes into contact with the control device 300 as it is to be described later, there is a possibility that heat is transferred to the control device 300 by air in the door cooling flow path and therefore, it is more necessary to cool of the component.

In some implementations, the door 20 may define a component cooling flow path for cooling components of the control device 300 independently of the door cooling flow paths P1 and P2.

The component cooling flow path is, for example, a flow path that passes through the door 20 in the horizontal direction. Each of configurations forming the component cooling flow path will be described later with reference to the drawings.

The control device 300 may further include cooling fans 360, 361, and 362 for cooling the display device 350.

The control housing 310 may be installed on the rear surface of the front panel 210.

A display window 212 may be defined at a position corresponding to the display device 350 in the front panel 210.

The control device 300 may further include a control cover 390 which covers the control housing 310.

The control housing 310 and the control cover 390 may restrict the heat transfer to the cooking chamber 12 from the display device 350 and cooling may be performed by the cooling fans 360, 361, and 362.

A connection bracket 380 is connected to the control cover 390 and the connection bracket 380 may be coupled to the side frames 220 and 221.

Wires may be connected to the display device 350, motors for driving the cooling fans 360, 361 and 362, and the like, and these wires may be inserted into the body 10. The wires may include a power line as well as a signal line.

For example, the wires may be guided by the side frames 220 and 221 and may extend downward and be then inserted into the body 10.

The control housing 310 may be fixed to the rear surface of the front panel 210 by adhesive means such as an adhesive or a double-sided tape.

The display device 350 may include a display PCB 351. The control housing 310 may include a first mounting portion 311 on which the display PCB 351 is installed. The first mounting portion 311 may be disposed at a central portion of the control housing 310, for example.

In some examples, the cooking appliance may include a display panel that is disposed between the display window 212 and the display PCB 351. The display panel may include an LCD panel configured to display information or a touch panel configured to display information as well as receive a touch command.

The control device 300 may further include a sensor 357. The control housing 310 may further include a second mounting portion 312 on which the sensor 357 is installed.

The sensor 357 may include, for example, a proximity sensor that senses proximity of a user. The second mounting portion 312 may be disposed at a position spaced apart from the first mounting portion 311 on one side of the first mounting portion 311.

The cooling fans 360, 361 and 362 may include a first cooling fan 360 and a second cooling fan 361 disposed adjacent to the second mounting portion 312.

The control housing 310 may further include fan installation ribs 315, 316 and 317 for installation of the first cooling fan 360 and the second cooling fan 361. The fan installation ribs 315, 316 and 317 may include a first installation rib 315 for installation of the first cooling fan 360 and a second installation rib 316 for installation of the second cooling fan 361.

The first installation rib 315 and the second installation rib 316 are spaced apart from each other and a common rib 317 may be configured to allow the first cooling fan 360 and the second cooling fan 361 to be installed together between the first installation rib 315 and the second installation rib 316.

That is, the first cooling fan 360 may be installed on the first installation rib 315 and one side of the common rib 317, and the second cooling fan 361 may be installed on the other side of the common rib 317 and the second installation rib 316.

The first cooling fan 360 and the second cooling fan 361 may be arranged in parallel based on the flow of air. That is, a direction in which the first cooling fan 360 and the second cooling fan 361 are arranged and a flow direction of air cross each other.

The first cooling fan 360 and the second cooling fan 361 operate such that air outside the door 20 is introduced into the control housing 310.

The second mounting portion 312 may be disposed closer to the first cooling fan 360 and the second cooling fan 361 than the first mounting portion 311.

Therefore, the sensor 357 installed in the second mounting portion 312 may be immediately cooled by air which flows by the first cooling fan 360 and the second cooling fan 361. and is introduced into the control housing 310. Thus, the sensor 357 may be kept below a reference temperature.

That is, the sensor 357 and the PCB connected to the sensor 357 are components that is to be managed at a low temperature and may be disposed adjacent to the first cooling fan 360 and the second cooling fan 361.

A third mounting portion 313 may be disposed at the opposite side of the second mounting portion 312 with respect to the first mounting portion 311.

A sensor PCB 355, in which a sensor configured to sensing the user's touch to open the door is installed, may be installed in the third mounting portion 313.

The cooling fans 360, 361, and 362 may further include a third cooling fan 362 disposed adjacent to the third mounting portion 313. For example, the first and second cooling fans 360 and 361 may be disposed at the first sidewall 330 of the control housing 310 where one or more air inlets are defined. In some examples, the third cooling fan 362 may be disposed at the second side wall 340 of the control housing 310 where one or more air outlets are defined. The first sidewall 330 and the second sidewall 340 may be lateral sidewalls of the control housing 310 that are spaced apart from each other in a width direction of the door 20.

The control housing 310 may further include a fan installation rib 318 for installation of the third cooling fan 362.

The third cooling fan 362 smoothly discharges the air inside the control housing 310 to the outside of the control housing 310.

The control device 300 may further include a barrier 370 for preventing air rising along the cooling flow paths P1 and P2 of the door 20 from flowing to the control housing 310.

The barrier 370 serves to partition the component cooling flow path and the door cooling flow paths P1, P2.

The control housing 310 may include a barrier connection portion 320 to which an end of the barrier 370 is connected and a barrier supporter 322 which supports the barrier 370.

The barrier connection portion 320 may include a fitting groove 321 into which the end of the barrier 370 is fitted.

The barrier 370 may have a shape corresponding to a thin plate that is bent one or more times.

For example, the barrier 370 may include a first portion 372 that is fitted into the fitting groove 321. The first portion 372 may be substantially perpendicular to the front panel 210 in a state where the first portion 372 is fitted into the fitting groove 321.

The barrier 370 may further include a second portion 374 that extends obliquely from the first portion 372.

The second portion 374 may be inclined upward from the first portion 372 as being away from the front panel 210 in a state in which the door 20 is closed.

The second portion 374 may guide the air rising along the cooling flow paths P1 and P2 to move smoothly toward the door air outlet 21.

The barrier 370 may further include a third portion 376 that is bent and extends from the second portion 374.

The third portion 376 extends, for example, in a direction away from the front panel 210 and may be substantially parallel to the first portion 372. Accordingly, the third portion 376 may be substantially perpendicular to the front panel 210.

The barrier 370 may further include a fourth portion 378 that is bent and extends from the third portion 376.

The fourth portion 378 may extend upwardly from the third portion 376 based on a state in which the door 20 is closed. The fourth portion 378 may extend vertically in the third portion 376, for example.

The barrier supporter 322 may support the barrier 370 fitted into the fitting groove 321. Although not limited thereto, a plurality of barrier supporters 322 may be disposed apart from each other to support the barrier 370.

The barrier supporter 322 may include a first contact 323 that comes into contact with the second portion 374 of the barrier 370 and a second contact 324 that comes into contact with the third portion 376 of the barrier 370.

The first contact 323 may include an inclined surface. The second contact 324 may include a fastening portion 325 to which a screw S1 is fastened. The screw S1 may be fastened to the fastening portion 325 through the third portion 376 in a state in which the third portion 376 is in contact with the second contact 324.

The barrier supporter 322 may further include a third contact 326 which the fourth portion 378 comes into contact with.

In some implementations, the reason why the screw S1 is fastened to the third portion 376 perpendicular to the front panel 210 is that the fastening of the screw S1 is easy and to reduce assembly failure in the case of fastening of the screw S1.

A sealing member 379 may be attached to the fourth portion 378 of the barrier 370. The sealing member 379 may be in contact with the control cover 390.

Therefore, air in the cooling flow paths P1 and P2 is prevented from being introduced into the control housing 310 through the gap between the barrier 370 and the control cover 390 by the sealing member 379.

Figure 8:
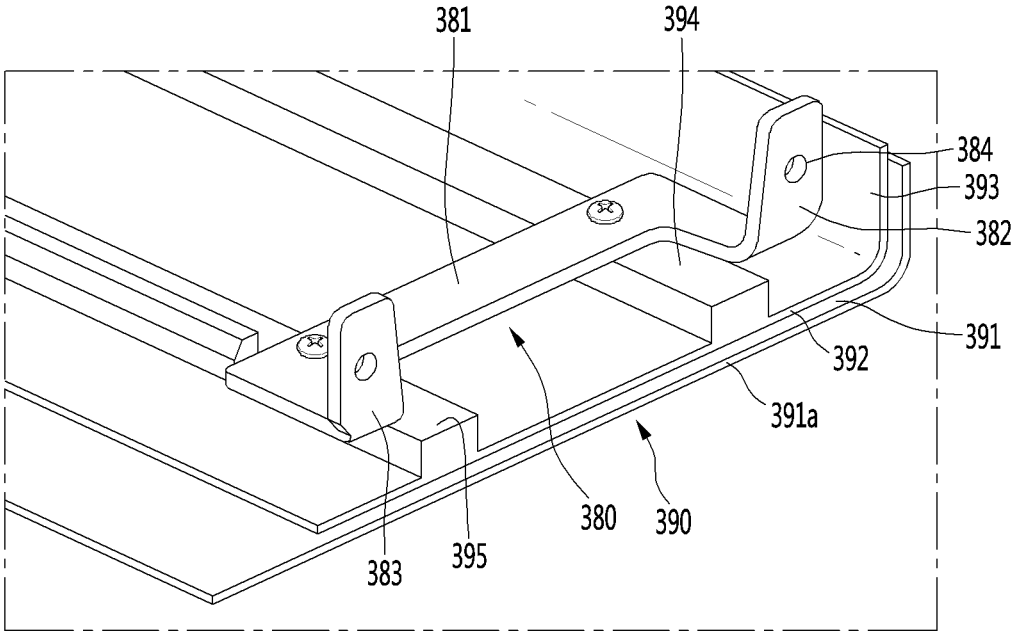
FIG. 8 is a view illustrating an example connection bracket that is connected to an example control cover.
Figure 9:
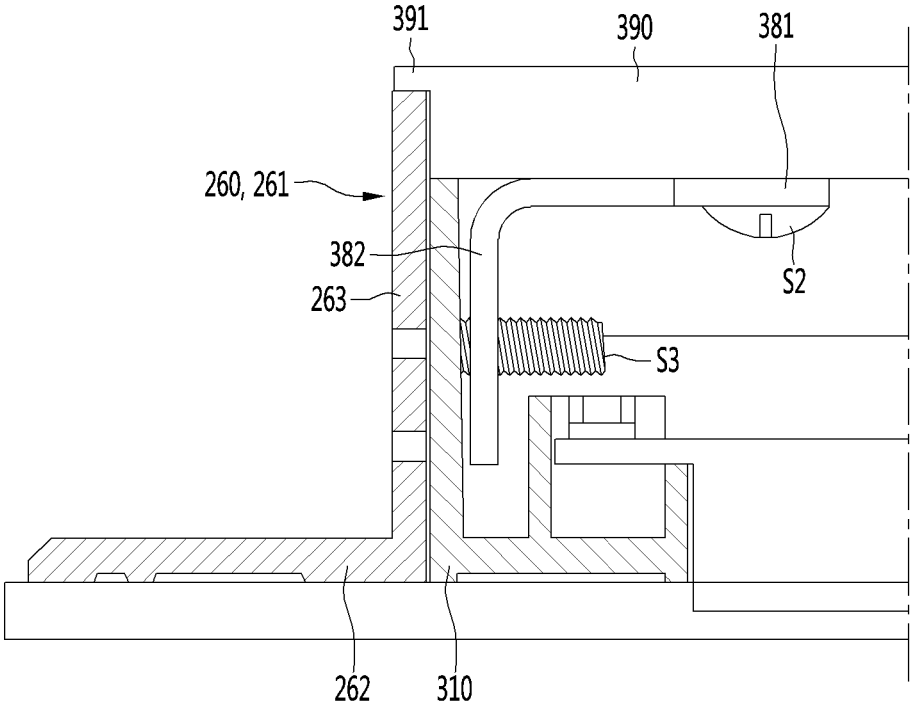
FIG. 9 is a cross-sectional view showing an example connection bracket that is connected to an example control housing and an example side decoration member.

FIG. 8 is a view illustrating an example connection bracket connected to an example control cover, and FIG. 9 is a cross-sectional view showing an example connection bracket connected to an example control housing and an example side decoration member.

Referring to FIGS. 3, 8 and 9, the control cover 390 may be made of a metal material, for example.

The side decoration members 260 and 261 and the lower decoration member 270 may be made of a metal material or as an injection molded plastic object.

In this case, the control cover 390 is exposed to the outside in a state where the door 20 is opened.

In some examples, the side decoration members 260 and 261 and the lower decoration member 270 may be made of a metal material. The control cover 390 may be made of the same material as the side decoration members 260 and 261 and the lower decoration member 270. In some examples, the control cover 390 may be made of an aluminum material.

In some implementations, the side decoration members 260 and 261 and the lower decoration member 270 may have a metal texture in the case of being the injection molded plastic object, and the control cover 390 may be made of an aluminum material so as to have the same texture. as the side decoration members 260 and 261 and the lower decoration member 270.

The control cover 390 includes a first body 391 and a second body 392 protruding from the first body 391 at a position inwardly spaced from an end 391*a* of the first body 391. Accordingly, the first body 391 and the second body 392 are stepped.

The second body 392 may include bracket fastening protrusions 394 and 395 to which the connection bracket 380 is fastened. In some cases, a plurality of bracket fastening protrusions 394 and 395 may be disposed to be spaced apart from each other.

Each of the plurality of bracket fastening protrusions 394 and 395 may elongate in a longitudinal direction of the control cover 390.

The connection bracket 380 may include a bracket body 381 and a pair of bent portions 382 and 383 that are bent from both ends of the bracket body 381.

The bracket body 381 may be in contact with a plurality of bracket fastening protrusions 394 and 395 and may be fastened to the plurality of bracket fastening protrusions 394 and 395 by screws S2.

Each of the pair of bent portions 382 and 383 may define a fastening hole 384 for fastening of the screw S3.

On the other hand, the side decoration members 260 and 261 may commonly include a first member 262 which comes into contact with the rear surface of the front panel 210 and a second member 263 which is bent and extends from the first member 262. The second member 263 may extend from the first member 262 to be perpendicular to the front panel 210, for example.

The first body 391 of the control cover 390 may be seated on the second members 263 of the side decoration members 260 and 261.

The second body 392 of the control cover 390 is positioned between the second members 263 of the pair of side decoration members 260 and 261 by the stepped portion of the control cover 390. The connection bracket 380 is positioned inside the control housing 310.

The screw S3 may be fastened to the bent portions 382 and 383 of the connection bracket 380 after sequentially passing through the side decoration members 260 and 261 and the control housing 310.

Figure 10:
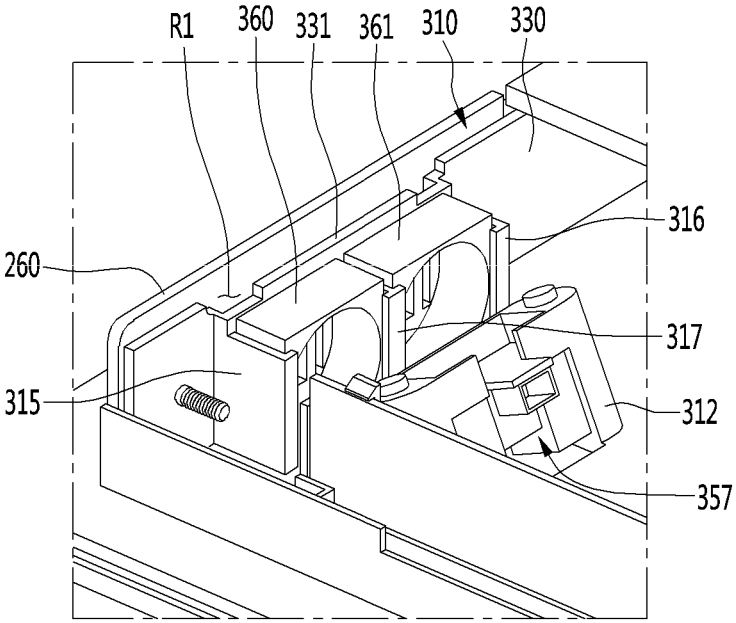
FIG. 10 is a view showing an example first cooling fan and an example second cooling fan installed in an example control housing.
Figure 11:
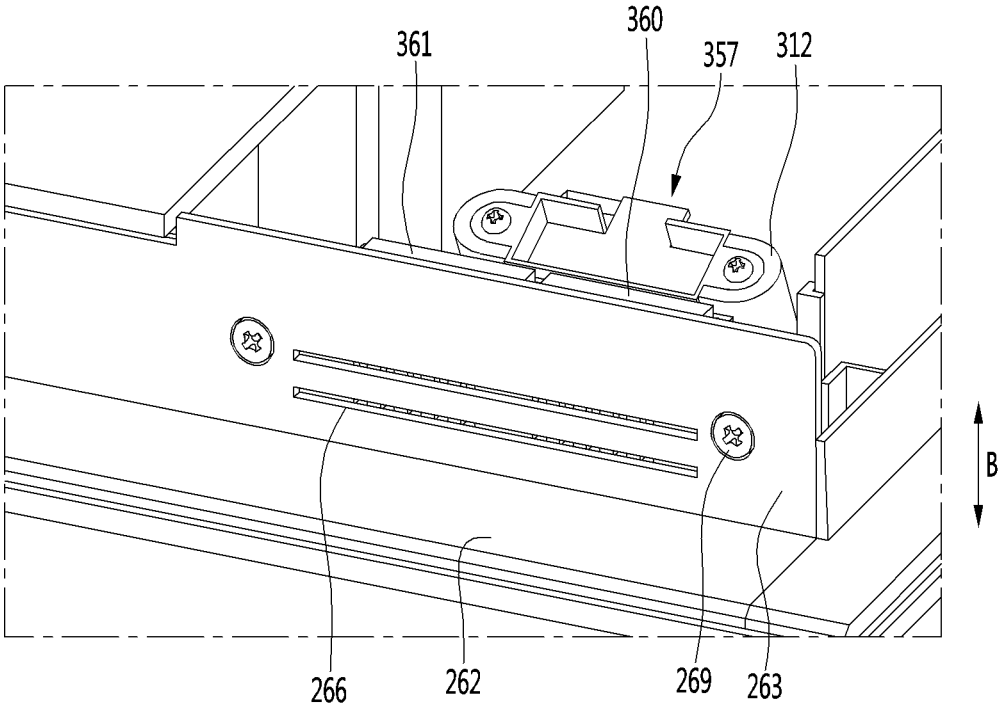
FIG. 11 is a view showing an example first side decoration member connected to an example control housing.
Figure 12:
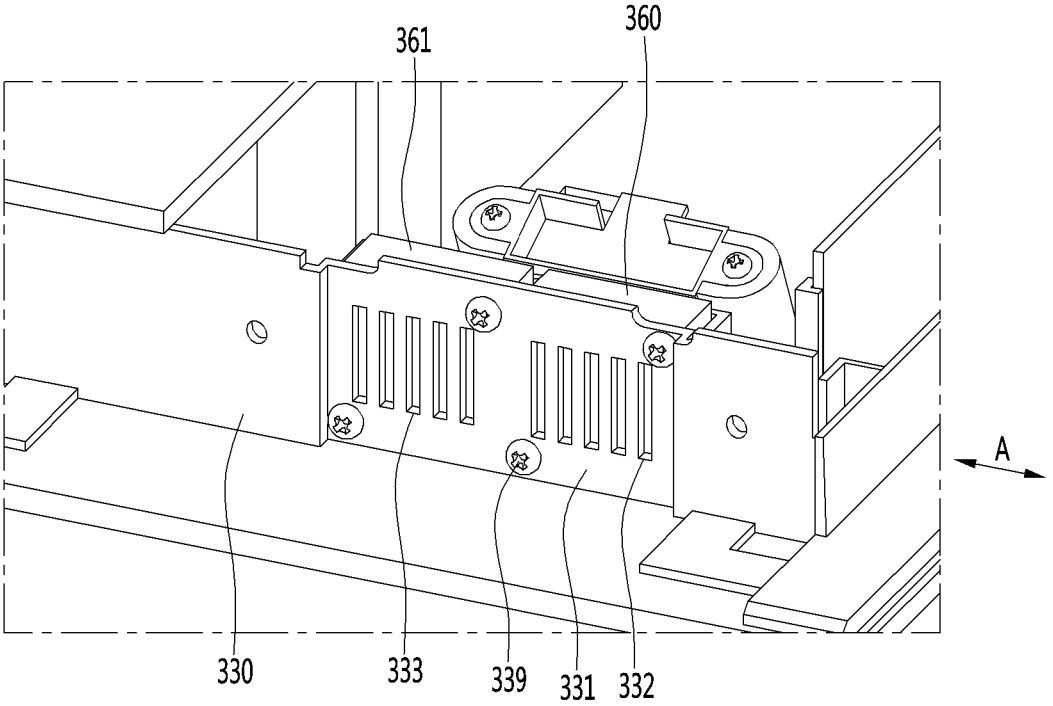
FIG. 12 is a view showing the control housing with the first side decoration member being detached in FIG. 11.

FIG. 10 is a view showing an example first cooling fan and a second cooling fan installed in an example control housing, FIG. 11 is a view showing the first side decoration member connected to an example control housing, and FIG. 12 is a view showing the control housing with the first side decoration member being detached from the control housing in FIG. 11.

Referring to FIGS. 10 to 12, the control housing 310 may include a first sidewall 330. The first sidewall 330 may include a first recessed wall 331 which is inwardly recessed. The fan installation ribs 315, 316, and 317 described above may be disposed at the first recessed wall 331. The first recessed wall 331 is recessed in a direction away from the first side decoration member 260.

A first air inlet 332 and a second air inlet 333 for air to flow may be defined in the first recessed wall 331.

In some examples, the first air inlet 332 may include a plurality of first air inlets 332 that face the first cooling fan 360.

In some examples, the second air inlet 333 may include a plurality of second air inlets 333 that face the second cooling fan 361.

In some implementations, the plurality of the first air inlets 332 and the plurality of the second air inlets 333 may be arranged in a first direction (e.g., in the direction of arrow A). Each of the air inlets 332 and 333 may extends in a second direction (e.g., in the direction of arrow B in FIG. 11) intersecting the first direction (for example, a direction perpendicular to the first direction). In some cases, as shown in FIG. 12, a width of each air inlets 332 and 333 in the direction of arrow A is narrower than a height in the direction of arrow B (see FIG. 11).

In this case, the first direction is a vertical direction when the door 20 is closed.

The first side decoration member 260 may come into contact with the front panel 210 and the control housing 310 outside the control housing 310.

The first side decoration member 260 is disposed outside the first sidewall 330. As described above, the first side decoration member 260 may include a first member 262 and a second member 263, and the second member 263 may come into contact with the first sidewall 330.

The second member 263 may be spaced apart from the first recessed wall 331 in a state where the second member 263 is in contact with the first sidewall 330.

Therefore, a first space R1 is defined between the first side decoration member 260 and the first sidewall 330 of the control housing 310 by the first recessed wall 331.

Even through bolts 339 pass through the first recessed wall 331 and are then fastened to the first cooling fan 360 and the second cooling fan 361 respectively, heads of the bolts 339 may be prevented from interfering with the first side decoration member 260 by the first space R1.

In the second member 263 of the first side decoration member 260, a first slit 266 through which air passes may be defined.

A plurality of first slits 266 may be defined in the second member 263, although not limited thereto. In this case, the plurality of first slits 266 may be arranged in the second direction, and each of the plurality of first slits 266 may elongate in the first direction.

The plurality of first slits 266 may be disposed to face the first air inlet 332 and the second air inlet 333.

The length of the plurality of first slits 266 (length in the A direction) may be equal to or longer than the maximum distance between the first air inlet 332 and the second air inlet 333 (distance in the A direction)

Accordingly, a part of the air passing through the first slit 266 passes through the first air inlet 332 and another part of the air passes through the second air inlet 333.

As the extending direction of the first slits 266 may be different from the extending direction of the air inlets 332 and 333 in some examples, the first cooling fan 360 and the second cooling fan 361 may be minimally exposed to the outside.

Since the extending direction of the plurality of first slits 266 is different from the extending direction of the air inlets 332 and 333, noise occurring when air passes through the first slits 266 and the air inlets 332 and 333 may be reduced.

The first cooling fan 360 and the second cooling fan 361 are installed in the first recessed wall 331, so that vibration occurring during the operation of the first cooling fan 360 and the second cooling fan 361 may be prevented from being directly transferred to the first side decoration member 260.

Figure 13:
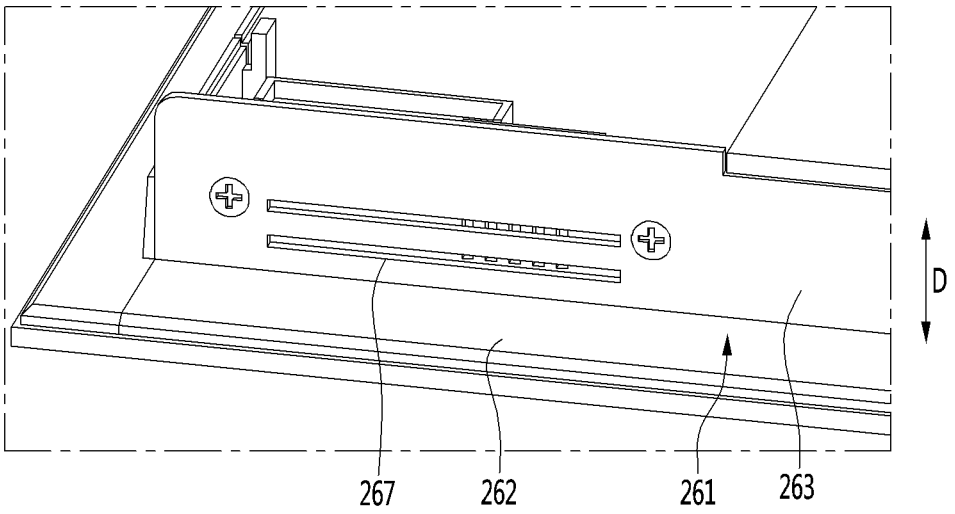
FIG. 13 is a view showing an example second side decoration member connected to an example control housing.
Figure 14:
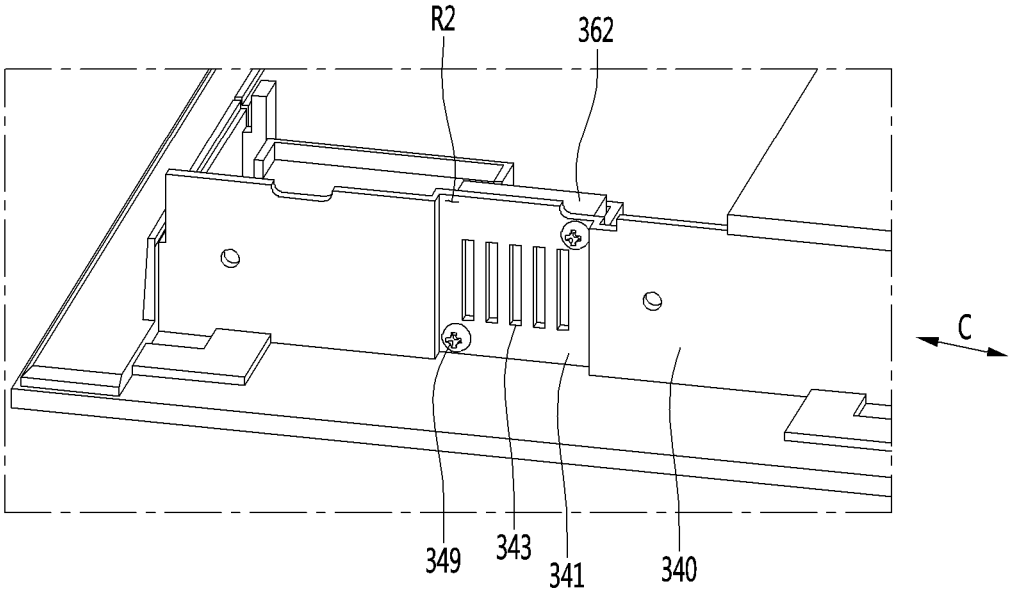
FIG. 14 is a view showing the control housing with the second side decoration member being detached in FIG. 13.

FIG. 13 is a view showing a state in which a second side decoration member is connected to a control housing, and FIG. 14 is a view showing a state in which the second side decoration member is detached the control housing in FIG. 13.

Referring to FIGS. 13 and 14, the control housing 310 may include a second sidewall 340. The second sidewall 340 is a wall disposed on the opposite side to the first sidewall 330.

The second sidewall 340 may include a second recessed wall 341 which is inwardly recessed. The first recessed wall 331 may be recessed in a direction away from the second side decoration member 261.

The fan installation rib 318 described above may be disposed at the second recessed wall 341.

The second recessed wall 341 may define an air outlet 343 through which air flows. In some examples, the air outlet 343 may include a plurality of air outlets 343 arranged to face the third cooling fan 362.

Although not limited thereto, the plurality of air outlets 343 may be arranged in a third direction (e.g., in the direction of arrow C). Each of the air outlets 342 may elongate in a fourth direction (e.g., in the direction of arrow D) that is a direction intersecting the third direction (for example, a direction perpendicular to the third direction).

In this case, the third direction is a vertical direction when the door 20 is closed. The second side decoration member 261 may come into contact with the front panel 210 and the control housing 310 outside the control housing 310.

The second side decoration member 261 is disposed outside the second sidewall 340. The second side decoration member 261 may include the first member 262 and the second member 263 as described above and the second member 263 may come into contact with the second sidewall 340 of the control housing 310, The second member 263 may be spaced apart from the second recessed wall 341 in a state in which the second member 263 is in contact with the second sidewall 340.

The second recessed wall 341 may define a second space R2 between the second side decoration member 261 and the second sidewall 340 of the control housing 310.

Even though bolts 349 pass through the second recessed wall 331 and are then fastened to the third cooling fan 362. Heads of the bolts 349 may be prevented from interfering with the second side decoration member 261 by the second space R2.

The second member 263 of the second side decoration member 261 may define a second slit 267 through which air passes.

A plurality of second slits 267 may be defined in the second member 263 of the second side decoration member 261, although not limited thereto. In this case, the plurality of second slits 267 may be arranged in the fourth direction, and each of the plurality of second slits 267 may elongate in the third direction.

The plurality of second slits 267 may be arranged to face the air outlet 343. The first slits 266 and the second slits 267 may be defined in the same number and length so as to increase the sense of unity in design.

In some examples, one cooling fan may be disposed at a position corresponding to the air outlet 343, and in other examples, a plurality of cooling fans may be disposed on the side of the air outlet 342 in a case in which the position of the sensor PCB 355 is variable.

In some examples, the extending direction of the second slit 267 may be different from the extending direction of the air outlet 343, where the third cooling fan 362 may be minimally exposed to the outside.

In addition, since the extending direction of the plurality of second slits 267 is different from the extending direction of the air outlet 343, noise occurring when air passes through the air outlet 343 and the second slits 267 may be reduced.

As the third cooling fan 362 is installed in the second recessed wall 341, vibration occurring during the operation of the third cooling fan 362 may be prevented from being directly transferred to the second side decoration member 261.

Figure 15:
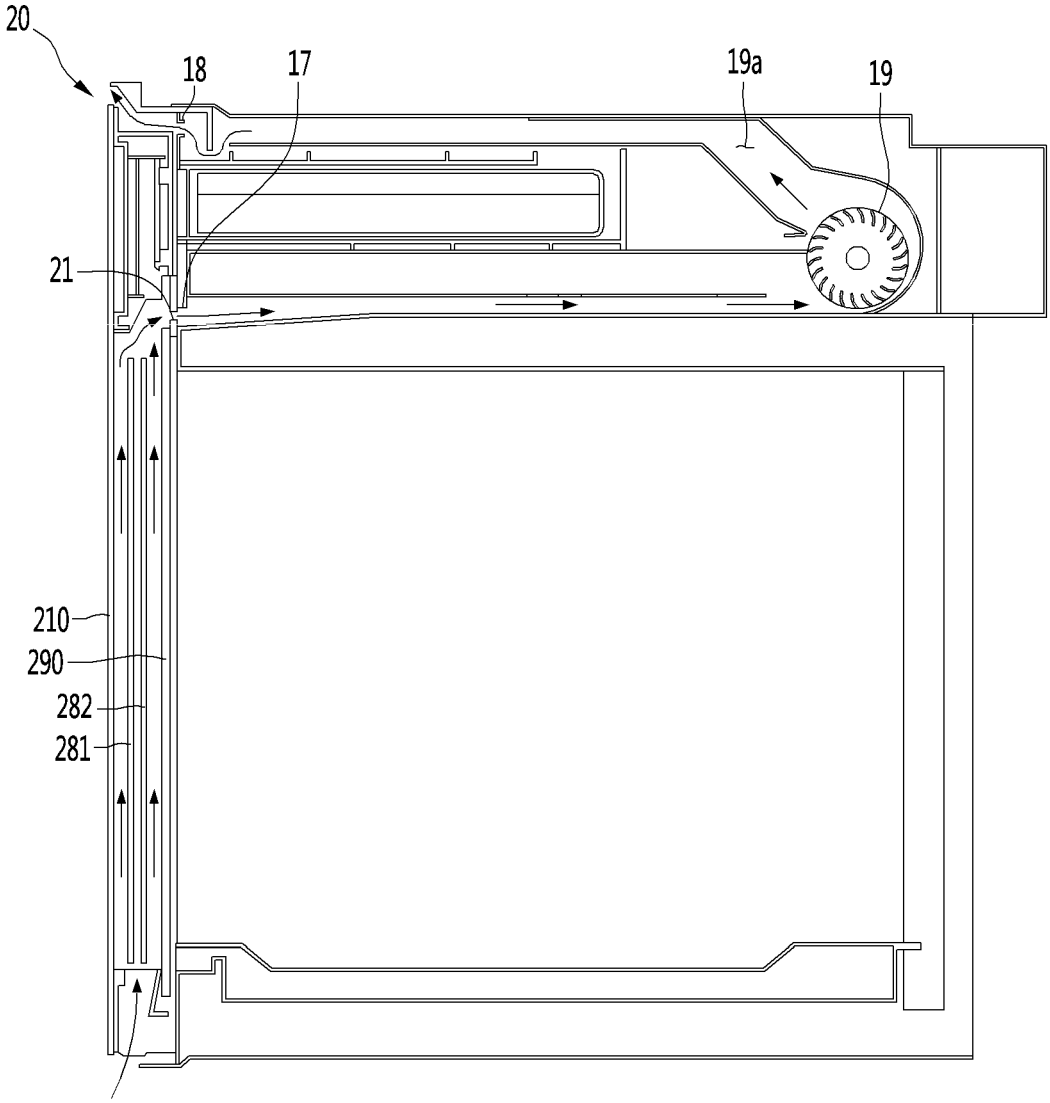
FIG. 15 is a view showing an example air flow in an example cooking appliance.
Figure 16:
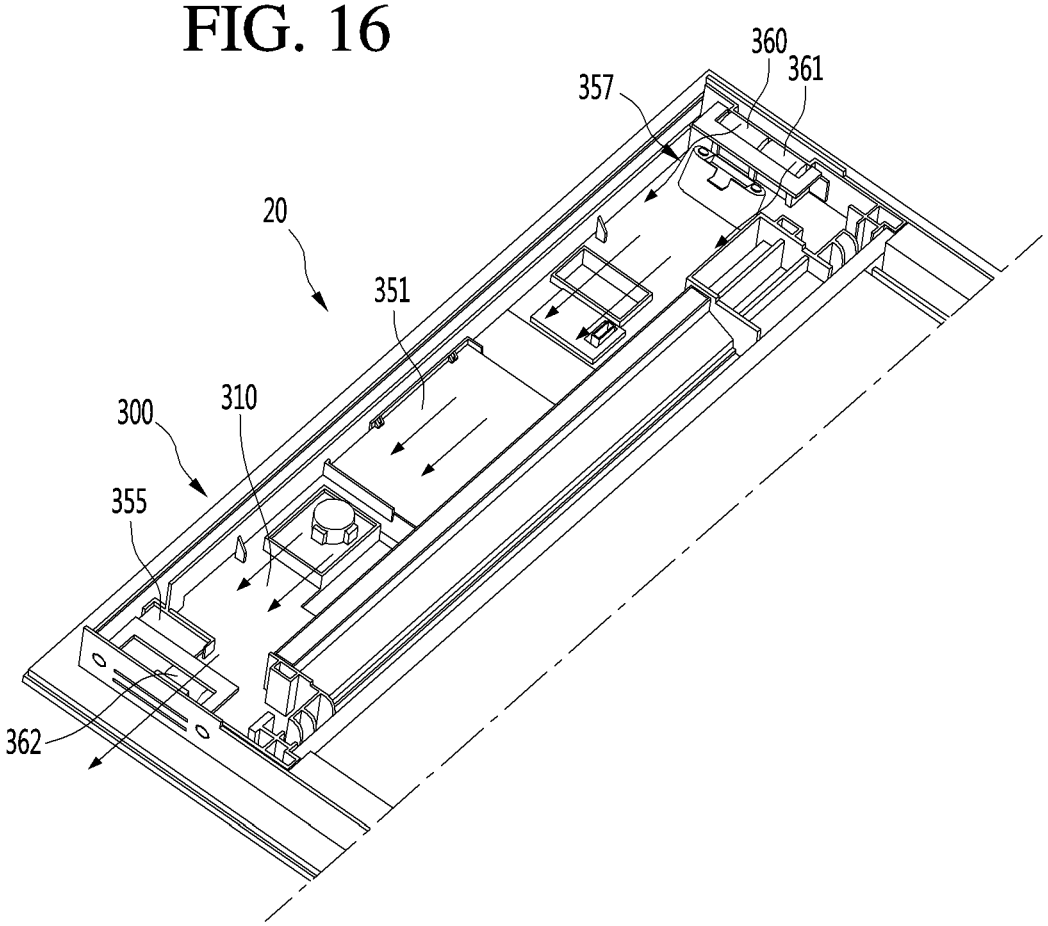
FIG. 16 is a view showing an example air flow in an example control device.

FIG. 15 is a view showing an example air flow in an example cooking appliance, and FIG. 16 is a view showing an example air flow in an example control.

Referring to FIGS. 1 to 16, in the some implementations, the component cooling flow path may be defined by the first slit 266, the first air inlet 332, the second air inlet 333, the inner space of the control housing 310, the air outlet 343 and the second slit 267.

For example, the component cooling flow path may extend in the horizontal direction in the door 20. That is, air may be introduced from one of both sides of the door 20 and discharged to the other side of the door 20.

In some examples, the body 10 may include a fan 19 configured to generate air flow, and may define a body flow path 19*a* through which air flows. The body flow path 19*a* may communicate with the body air inlet 17 and the body air outlet 18.

The door air outlet 21 communicates with the body air inlet 17 when the door 20 is closed.

Therefore, when the cooking appliance 1 operates, the fan 19 operates and the rotating force of the fan 19 acts on the door 20. Air is then introduced into the door 20 through a hole 240*a* defined in the lower frame 240 from the lower side of the door 20.

In the door 20, the air cools the door 20 while rising along the first and second cooling flow paths P1 and P2.

The air that has passed through the first and second cooling flow paths P1 and P2 is diverted by the barrier 370, is discharged from the door 20 through the door air outlet 21, and flows through the body air inlet 17 along the body flow path 19*a*.

The air flowing along the body flow path 19*a* is discharged from the body 10 through the body air outlet 18. The air that has passed through the body air outlet 18 flows outward through a gap between the control device 30 and the body panel 16.

In some examples, the first cooling fan 360, second cooling fan 361, and third cooling fan 362 may operate to cool the control device 300.

When the first cooling fan 360 and the second cooling fan 361 operate, the air outside the door 20 passes through the first slit 366 of the first side decoration member 260 and is then introduced into the control housing 310 through the first air inlet 332 and the second air inlet 333. That is, air is introduced into the control device 300 through one side of the door 20.

The air introduced into the control housing 310 first cools the sensor 357 while flowing along the sensor 357.

The air which has cooled the sensor 357 flows toward the display PCB 351 to cool the display PCB 351.

A part of the air which has cooled the display PCB 351 cools the sensor PCB 355 and another part is discharged through the air outlet 343 by the third cooling fan 362. That is, the air is discharged through the other side of the door 20.

Since the third cooling fan 362 is positioned adjacent to the air outlet 343, air inside the control housing 310 may smoothly flow toward the third cooling fan 362.

The air discharged through the air outlet 343 is finally discharged from the door 20 through the second slit 267 of the second side decoration member 261.

In some implementations, the component cooling flow path may be arranged such that air is introduced from one sidewall of the control device and then discharged to the other sidewall. The length of the component cooling flow path may be increased to cool components with an improved cooling performance for the components.

In some implementations, the first cooling fan and the second cooling fan positioned on the air inlet side are referred to as an inlet-side cooling fan, and the third cooling fan positioned on the air outlet side is referred to as an outlet-side cooling fan.

The inlet-side cooling fan is disposed near the air inlet. The outlet-side cooling fan is disposed near the air outlet. For example, the inlet-side cooling fan may be disposed at a first position closer to the air inlet than the air outlet, and the outlet-side cooling fan may be disposed at a second portion closer to the air outlet than the air inlet. The first position and the second position may be spaced apart from each other, or may include some portions overlapping with each other.

In some implementations, the cooling performance for the components of the control device may be improved by including the door cooling flow path as well as the component cooling flow path for cooling the components of the control device.

In addition, the control device includes the barrier to be connected to the control housing, thereby preventing the air that has cooled the door from flowing to the control housing, and allowing air to flow smoothly to the body by the inclined portion of the barrier.

In addition, the component cooling flow path is arranged such that air is to be introduced from one sidewall of the control device and to be discharged to the other sidewall, and therefore, the length of the component cooling flow path is increased, thereby sufficiently cooling the components and improving cooling performance for the components.

In addition, since components to be managed at a low temperature are positioned on the inlet side of the component cooling flow path, thereby smoothly and promptly achieving cooling of the components.

In some implementations, the cooling fans may be disposed not only on side of the air inlet of the control housing, but also on side of the air inlet, thereby smoothly achieving cooling of the components that make up the control device.

In some implementations, the cooling fan may be not installed in the side decoration member positioned at the outermost position in the door, but the cooling fan may be installed in the control housing positioned inwardly than the side decoration member, thereby preventing vibration due to the operation of the cooling fan from being directly transferred to the side decoration member.

In some implementations, the recessed wall may be recessed in the sidewall of the control housing and spaced apart from the side decoration member, and therefore, it may be possible to prevent the head of a bolt from interfering with the side decoration member even through the cooling fan is fixed by performing fastening operation using the bolt outside the control housing.

In some implementations, the extending direction of the slit defined in the side decoration member may be different from the extending direction of the air inlet and the air outlet of the control housing, thereby reducing noise occurring when air passes through the slit, the air inlet, and the air outlet respectively.

In some implementations, the extending direction of the slit defined in the side decoration member may be different from the extending direction of the air inlet and the air outlet of the control housing and therefore, exposure of the cooling fan to the outside may be minimized.

What is claimed is:

1. A cooking appliance comprising a body that defines a cooking chamber therein;

a door rotatably connected to the body by a hinge mechanism and configured to open and close the cooking chamber;

a control device disposed in the door and configured to accommodate heat-generating components therein;

a door cooling flow path disposed in the door; and a component cooling flow path disposed to pass through the control device, the component cooling flow path being configured to cool the heat-generating components, wherein the door cooling flow path and the component cooling flow path are partitioned to block communication of air flowing through each flow path.

2. The cooking appliance according to claim 1, wherein the control device further comprises a barrier disposed between the door cooling flow path and the component cooling flow path to partition the door cooling flow path and the component cooling flow path from each other.

3. The cooking appliance according to claim 2, wherein the component cooling flow path is disposed above the barrier, and the door cooling flow path is disposed below the barrier.

4. The cooking appliance according to claim 2, wherein the door comprises a door air outlet from which the air passing through the door cooling flow path is discharged, and the barrier is configured to guide the air flowing through the door cooling flow path toward the door air outlet.

5. The cooking appliance according to claim 1, wherein the component cooling flow path and the door cooling flow path are disposed to be intersected with each other.

6. The cooking appliance according to claim 1, wherein the door cooling flow path extending from the door in a vertical direction.

7. The cooking appliance according to claim 1, wherein the component cooling flow path extends from the door in a horizontal direction.

8. The cooking appliance according to claim 1, wherein the body comprises:

a fan configured to generate a flow of air;

a body air inlet and a body air outlet, which are provided in a front end of the body; and a body flow path configured to allow the body air inlet and the body air outlet to communicate with each other.

9. The cooking appliance according to claim 8, wherein the door comprises a door air outlet from which the air passing through the door cooling flow path is discharged, and in a state in which the door is closed, the body air inlet and the door air outlet are configured to communicate with each other.

10. The cooking appliance according to claim 1, wherein the heat-generating components comprise a display device disposed between an inlet side of the component cooling flow path and an outlet side of the component cooling flow path.

11. The cooking appliance according to claim 10, wherein the heat-generating components further comprise a sensor disposed between the display device and the inlet side of the component cooling flow path.

12. The cooking appliance according to claim 1, wherein one or more cooling fans are disposed at each of an inlet side and an outlet side of the component cooling flow path.

* * * * *